US008414315B2

(12) United States Patent
Dekoski

(10) Patent No.: US 8,414,315 B2
(45) Date of Patent: Apr. 9, 2013

(54) LEVER TYPE ELECTRICAL CONNECTOR

(75) Inventor: Kurt P. Dekoski, Macomb, MI (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 12/991,547

(22) PCT Filed: May 6, 2009

(86) PCT No.: PCT/US2009/043032

§ 371 (c)(1),
(2), (4) Date: Jan. 31, 2011

(87) PCT Pub. No.: WO2009/137615

PCT Pub. Date: Nov. 12, 2009

(65) Prior Publication Data

US 2011/0124213 A1 May 26, 2011

Related U.S. Application Data

(60) Provisional application No. 61/126,697, filed on May 6, 2008.

(51) Int. Cl.
*H01R 13/62* (2006.01)

(52) U.S. Cl. ..... 439/157

(58) Field of Classification Search ..... 439/157, 439/152–153, 372, 341, 347
See application file for complete search history.

(56) References Cited

U.S. PATENT DOCUMENTS

| | | | | |
|---|---|---|---|---|
| 5,322,448 | A * | 6/1994 | Hahn | 439/157 |
| 5,564,935 | A * | 10/1996 | Yagi et al. | 439/157 |
| 5,873,745 | A | 2/1999 | Duclos et al. | |
| 6,213,795 | B1 * | 4/2001 | Drescher et al. | 439/157 |
| 6,899,554 | B1 * | 5/2005 | Osada | 439/157 |
| 6,971,894 | B2 * | 12/2005 | Dillon et al. | 439/157 |
| 7,563,114 | B2 * | 7/2009 | Patterson | 439/157 |
| 7,670,159 | B2 * | 3/2010 | Shamoto et al. | 439/157 |
| 8,057,245 | B2 * | 11/2011 | Sakamaki et al. | 439/157 |

FOREIGN PATENT DOCUMENTS

FR 2 803 111 A1 6/2001

OTHER PUBLICATIONS

International Search Report for PCT/US2009/043032.

* cited by examiner

*Primary Examiner* — Jean F Duverne
(74) *Attorney, Agent, or Firm* — Larry I. Golden; Clarence R. Moon

(57) ABSTRACT

The present disclosure provides an electrical connector assembly having electrical connectors that are matingly connected and disconnected by operation of a lever actuator of one of the connectors. The lever is pivotally connected to one of the connectors and includes a drive gear at an end thereof. Each drive gear has gear teeth and a cam projection. The gear teeth of the drive gear mesh with gear teeth of a follower or mating gear pivotally mounted on the housing of the connector carrying the lever. The mating gear also includes a cam projection. The other connector has cam grooves positioned to engage with each cam projection such that movement of the lever causes drive gear to pivot all the cam projections to engage cam grooves and move the connectors to a fully mated condition.

16 Claims, 9 Drawing Sheets

10
A
24
16
27
30
38
28
20
33
12
26
23
57
55
52
50
33
19
25
31
21
18
52
60
50
14
58
54
22
35
58
56
22
54
61
61
32

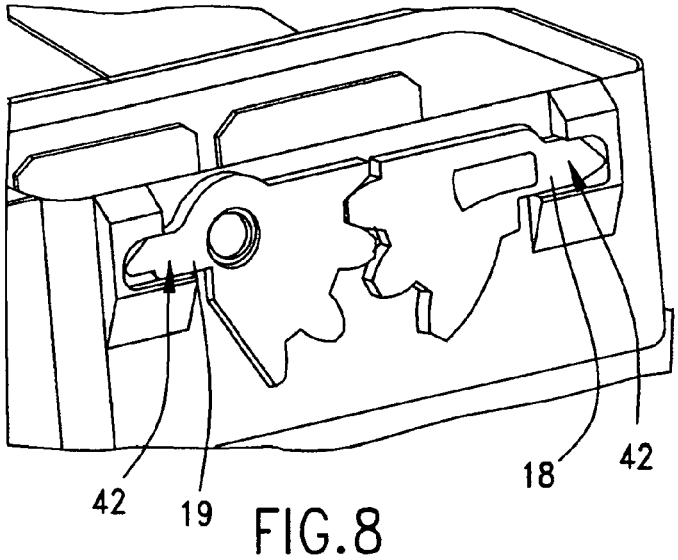
FIG.8
FIG.9
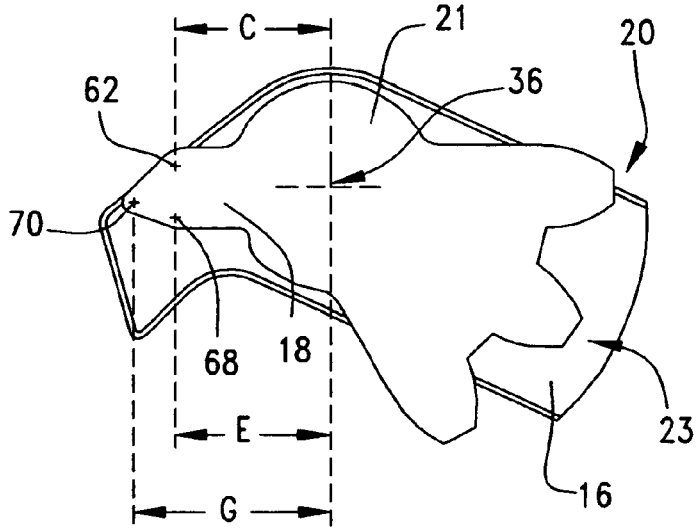
FIG.10
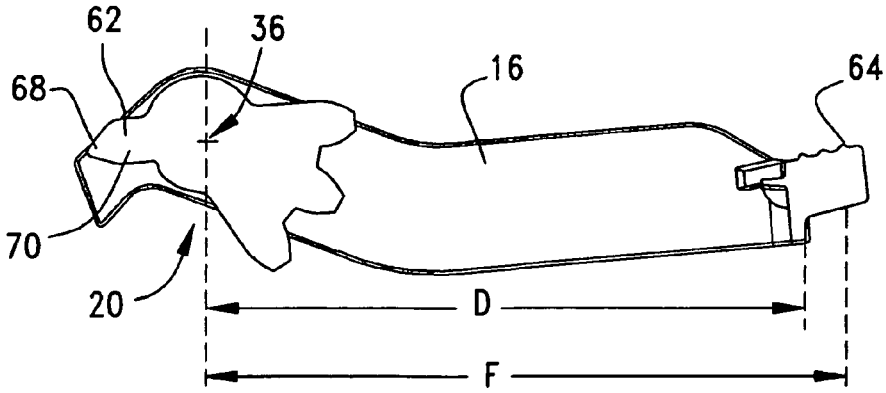

FIG.17
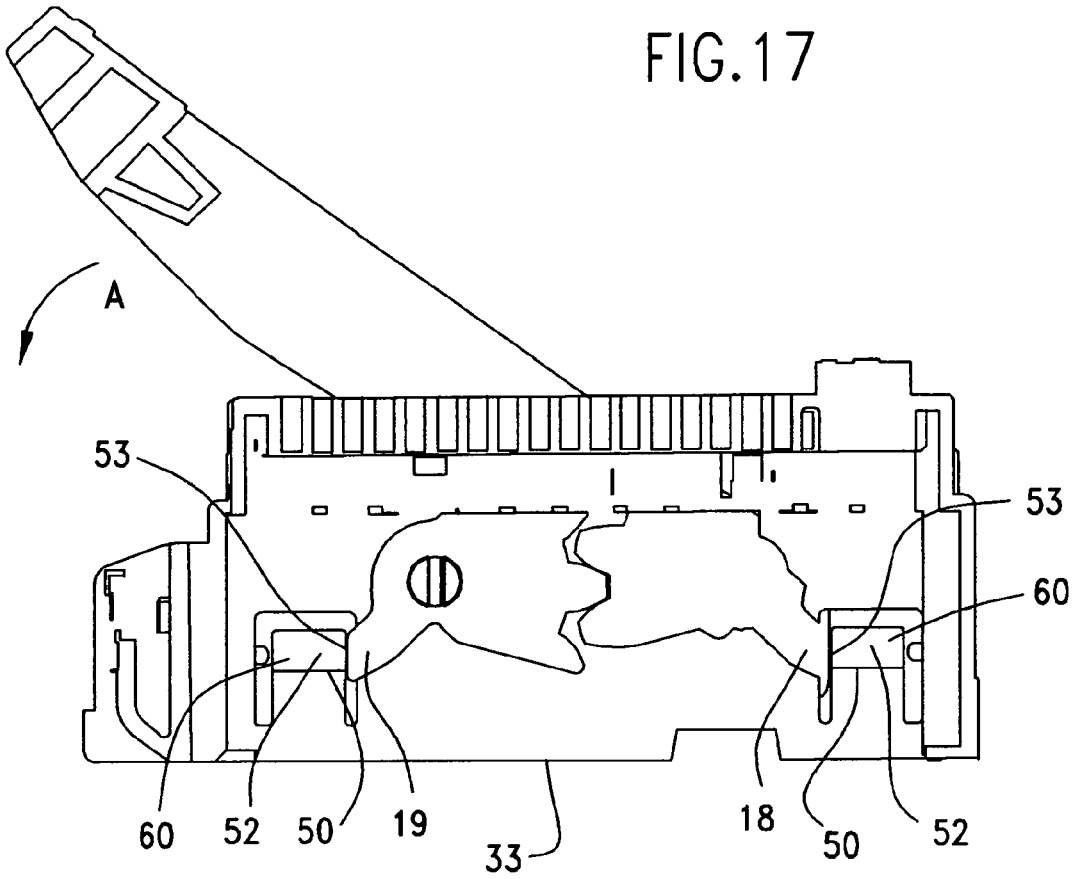
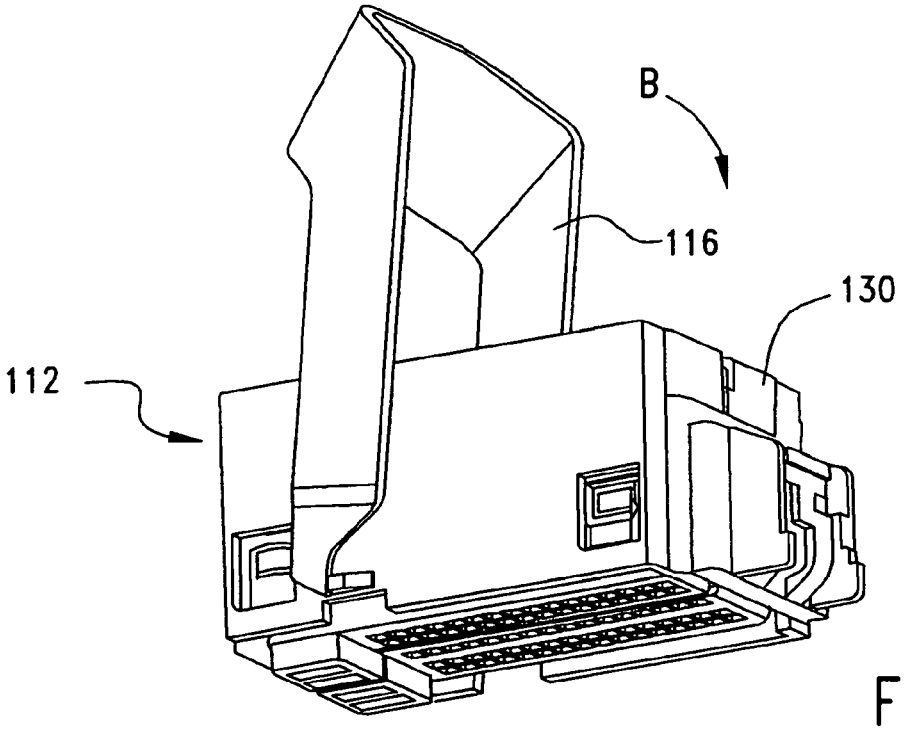
FIG.20

LEVER TYPE ELECTRICAL CONNECTOR

This application claims the benefit of U.S. Provisional Patent Application Ser. No. 61/126,697 filed on May 6, 2008, which is hereby incorporated herein by reference in its entirety.

FIELD OF THE INVENTION

This invention generally relates to electrical connector assemblies and, more particularly, to an electrical connector assembly including electrical connectors that are matingly connected and disconnected by operation of a lever actuator of one of the connectors.

BACKGROUND OF THE INVENTION

A typical lever-type electrical connector includes an assembly of a first connector or housing and a second connector or header. To mate the connectors together, the assembly has an actuating or assist lever mounted for pivoting on the first connector with pivoting of the lever causing the first and second connectors to shift between unmated and fully mated configurations. To this end, the actuating lever and the second connector typically have a cam groove and a cam follower arrangement for drawing the second connector into mating condition with the first connector in response to pivoting of the lever. Such connectors are commonly used in the automotive industry; however, other uses are also possible.

A typical configuration for such lever-type electrical connectors is to provide a generally U-shaped lever structure having a pair of relatively thin walled lever arms that are disposed on opposite sides of the housing connector. The lever arms may have cam grooves for engaging cam follower projections or posts on opposite sides of the header assembly. These types of lever connectors are often used where relatively large forces are required to mate and unmate a pair of connectors. For instance, frictional forces encountered during connecting and disconnecting the connectors may make the process difficult to perform by hand. In some cases, relatively large electrical connectors with high pin counts, such as connectors with 90 or more pin contacts, require at least about 300 N to mate or un-mate the connectors. On the other hand, automotive industry standards specify a maximum of 75 N of user input force be required to perform this mating and unmating of the connectors.

It has been found that current lever-actuator configurations cannot effectively mate or un-mate large connectors such as described above while keeping user input force at or below the level specified by the industry standard. With current lever connector configurations, the mechanical advantage provided by the lever actuators is not sufficient to overcome the high frictional forces seen by large electrical connector assemblies between pins and sockets of the connectors as they are mated and un-mated. At the interface between the cam projection and grooves, there are inefficiencies generated in the force transfer between the input force applied to the lever and the output force applied by the lever to the other connector requiring greater efforts by the user than as desired for mating and unmating the connectors together.

U.S. Pat. No. 6,099,330 to Gundermann et al. discloses an electrical connector assembly having a lever for mating and unmating electrical connectors. However, the connector of the '330 patent is disclosed as being used with a connector assembly with only 38 contacts, which is less than half the number of pin contacts employed in the large electrical connector assemblies described above. The configuration of the interface between the cam of the lever and the caroming surface of the header electrical connector of the '330 electrical assembly connector is not suitable for larger connectors because the lever does not generate a sufficient mechanical advantage using only 75 N or less of input force to shift the connectors to a mated position relative to each other. The connector assembly in the '330 patent employs an assist lever with curved cam engagement surfaces. Such a curved surface does not provide a fixed contact location between the curved cam surface of the lever and cam surface area of the header connector as the lever is pivoted, but instead generates a rolling action in the cam surface area so that the leverage and output force generated by pivoting of the lever for mating the connectors together is variable. This makes precision design of such a lever to provide the mechanical advantage necessary for mating of large connector assemblies extremely difficult. In addition, the variable engagement of the curved cam force transmitting surfaces generates an inefficient transfer of forces therebetween. This variable and rolling engagement between the lever and cam surface area typically will not generate the concentrated, high levels of output forces (e.g., greater than 300 N) with relatively low actuator forces applied to the lever (e.g., 75 N or less).

In many cases, it can be necessary for the actuating lever to be locked in an initial or pre-mate position so that the actuating lever is properly aligned for assembly of the electrical connectors. By locking the lever in such a position, the connectors can be mated without having to reposition the actuating lever to this aligned position for connector mating. Current connector configurations, such as the lever design in the '330 patent, utilize a flexible or resilient portion on the lever itself at the ends of relatively thin arms thereof to lock the lever in the pre-mate position. In order to release the lever, the resilient end portions of the lever arms are flexed or bent away from their locked position so that the lever is free to pivot. Since the thin lever arms are used to generate the output force for mating and umating the connectors, generally it is undesirable to have these lever arms be flexed or deformed during pivoting of the lever actuator.

Accordingly, there is a need for a lever actuator for an electrical connector assembly that generates a more efficient mechanical advantage, particularly with large electrical connectors that require the lever actuator to be able to generate large output forces without requiring large input actuator forces on the lever. In addition, a lever actuator that is not deformed as it is pivoted would be desired. It is further desirable to provide a more robust pivot track on the header. Additionally, it is desirable to maintain the mating surfaces parallel to each other as the connector halves are drawn together.

SUMMARY

In one aspect of the present disclosure a connector assembly is provided including a first connector having a generally rectangular housing for carrying first electrical contacts. The housing has an access channel for receiving a lever assembly and the lever assembly has a generally U-shape with opposite extending end portions. A drive gear is carried on the inner portion of each end portion. The drive gear has a lever lobe extending from one side and a plurality of drive teeth extending from another side. A pair of mating gears is rotatably carried by said first connector. Each mating gear has a lever lobe extending from one side and a plurality of mating teeth extending from another side. The mating gears have their mating teeth in mating relationship respectively with the drive teeth of the drive gears. A second connector defines a generally rectangular header for carrying second electrical contacts for respective connection to the first electrical contacts in response to the second connector being fully engaged with the first connector. The header includes a pair of cam tracks on each longitudinal side of the header for respectively receiving the lever lobes of the drive gears and mating gears. The lever assembly has a first position whereat the header is in an unengaged position with respect to the first connector and the lever assembly is rotatable to a second position whereat the drive gears and associated mating gears are moved to cause said lever lobes within the cam tracks to move the header to said fully engaged position.

In another aspect of the present disclosure a connector assembly is provided including a first connector having a housing for mounting first terminals. The first connector housing has a first side and a second side opposite the first side. Each of the first and second sides of the first connector housing includes a follower gear pivotally mounted thereto and has gear teeth at one end and a cam projection at another end. A second connecter includes a housing for mounting second electrical terminals for respective connection to the first terminals upon mating of first and second connectors. The second connector housing includes a first side and a second side opposite the first side and a pair of spaced apart cam grooves on each of the first and second sides of the second connector housing. A lever is movable from a first position to a second position and includes two arms. Each arm is mounted to opposite sides of the first connector housing and includes an end portion. Each end portion includes a drive gear having gear teeth at one end and a cam projection at another end. The gear teeth of each of the drive gears are positioned in engaging mating relation with the gear teeth of a corresponding follower gear such that drive gears and follower gears can be pivoted by movement of the lever, wherein when the lever is in said first position, each cam projection is in a position to be received in a respective cam groove and movement of the lever from the first position to the second position causes cam projections received in the cam grooves to bring first and second connectors together to a fully mated position.

In yet another aspect of the present disclosure a connector assembly is provided including a first connector having a generally rectangular housing for carrying first electrical contacts, the housing has a latch member. A U-shaped lever assembly has first and second opposing arms connected by a bridge member. The first and second arms are pivotally mounted to the first connector housing. Each arm has an end portion. The lever assembly has a locking member for engaging the latch member to prevent movement of the lever assembly. A drive gear is carried on the inner portion of each end portion. The drive gear has a cam projection extending from one side and a plurality of drive teeth extending from another side. A first mating gear is pivotally mounted to a first longitudinal side of the first connector housing adjacent a corner thereof and a second mating gear is pivotally mounted to an second opposite longitudinal side of the first connector housing adjacent a corner thereof. Each mating gear has a cam projection extending from one side and a plurality of mating teeth extending from another side. The mating gears have their mating teeth in mating relationship respectively with the drive teeth of the drive gears. A second connector defines a generally rectangular header for carrying second electrical contacts for respective connection to the first electrical contacts in response to the second connector being fully engaged with the first connector. The header includes a pair of cam tracks on each longitudinal side of the header for respectively receiving the cam projections of the drive gears and mating gears. The cam tracks are positioned adjacent a corner of the housing. The lever assembly is movable from a first position where the cam projections are positioned to engage cam tracks to a second position wherein the drive gears and associated mating gears are moved to cause the cam projections to engage the cam tracks to move the first and second connector to a fully mated position.

BRIEF DESCRIPTION OF THE DRAWINGS

In the following detailed description, reference will frequently be made to the following views of the drawing, in which like reference numerals refer to like components, and in which:

FIG. 8 is cross-section view taken at line 8-8 shown in FIG. 7;

FIG. 9 is an elevation view of the lever arm end showing the lever arm drive gear of the lever assembly;

FIG. 10 is an elevation view of one of the lever arms of the lever assembly;

FIG. 17 is a cross-sectional view of first or housing connector showing lever arm drive gear engaged with housing drive gear in the pre-mate or first position;

FIG. 20 is a perspective view of another embodiment of a first or housing connector with the lever arm in the first or un-mated position.

DETAILED DESCRIPTION OF EMBODIMENTS

This invention relates to the connectors of the type shown in U.S. Pat. No. 7,396,242, which is hereby incorporated herein by reference in its entirety. This patent discloses, for example, details concerning mating-connector housings, actuating levers, pre-mated and mated or locked conditions and features, blocking components, cams and cam action for mating and unmating, and means and mechanisms for shifting blocking members and for facilitating mating and unmating operation.

As required, detailed embodiments are disclosed herein; however, it is to be understood that the disclosed embodiments are merely exemplary of present approach, which may be embodied in various forms. Therefore, specific details disclosed herein are not to be interpreted as limiting, but merely as a basis for the claims and as a representative basis for teaching one skilled in the art to variously employ the present approach in virtually any appropriate manner.

Figure 1:
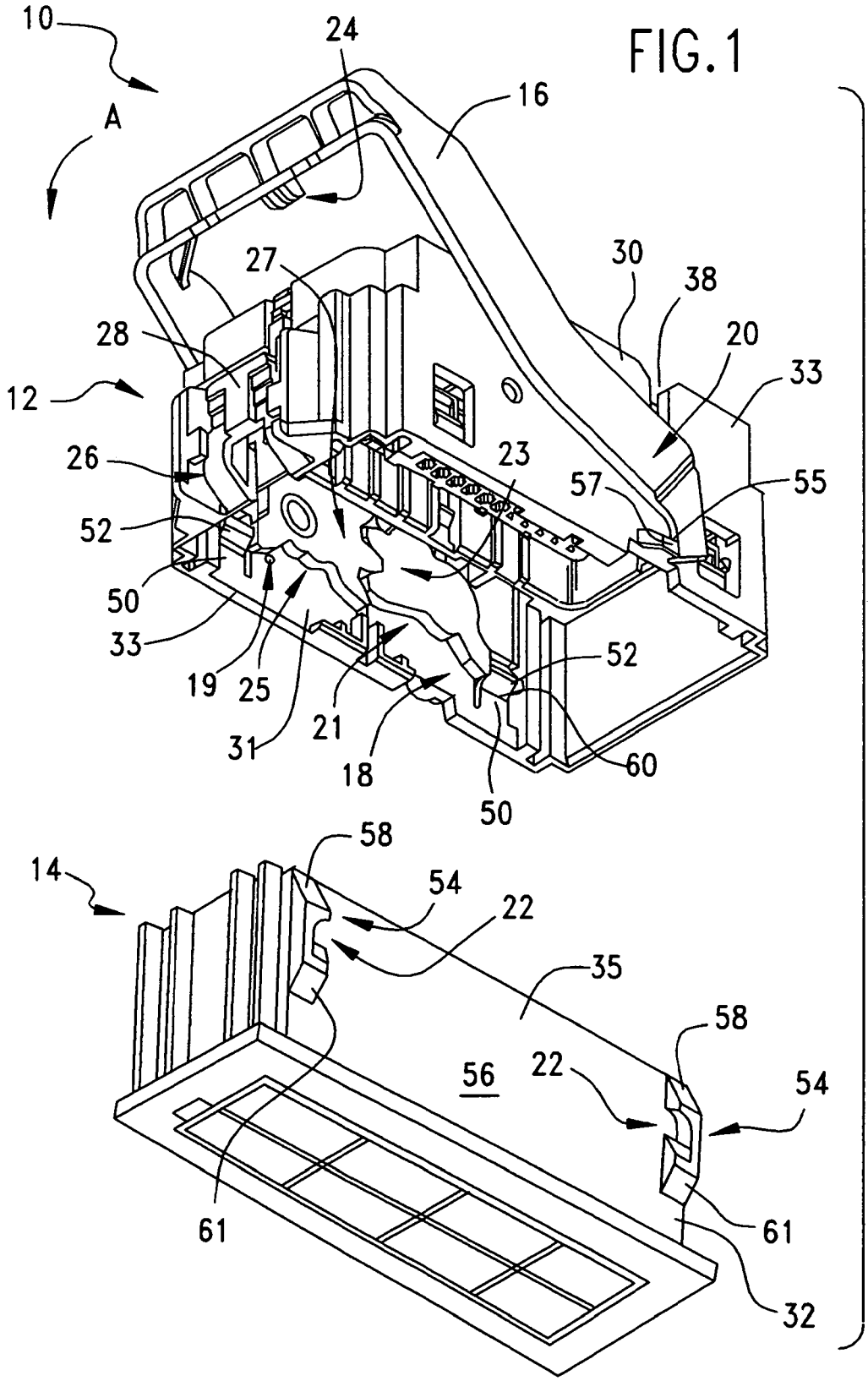
FIG. 1 is a perspective front view of one embodiment a lever connector assembly according to the present disclosure including a first and second connector shown in an unassembled relation with an actuating lever in an pre-mate or first position.
Figure 2:
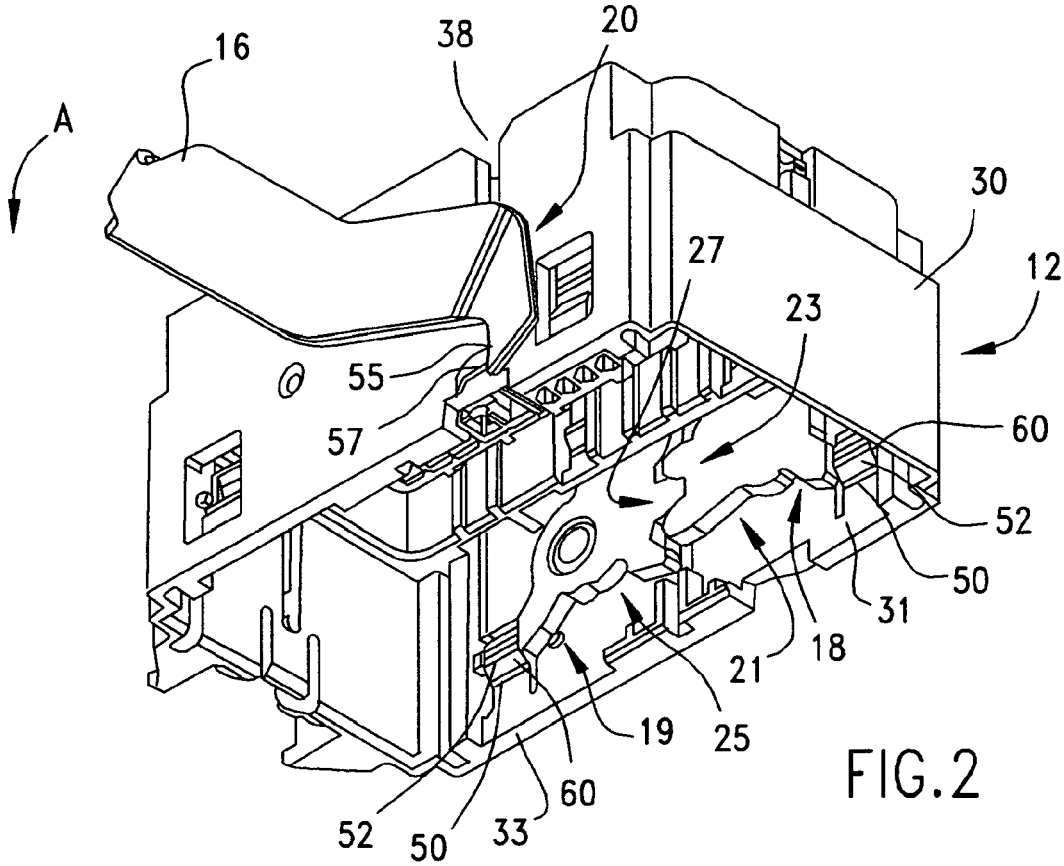
FIG. 2 is a perspective rear view of the first connector shown in FIG. 1.
Figure 2A:
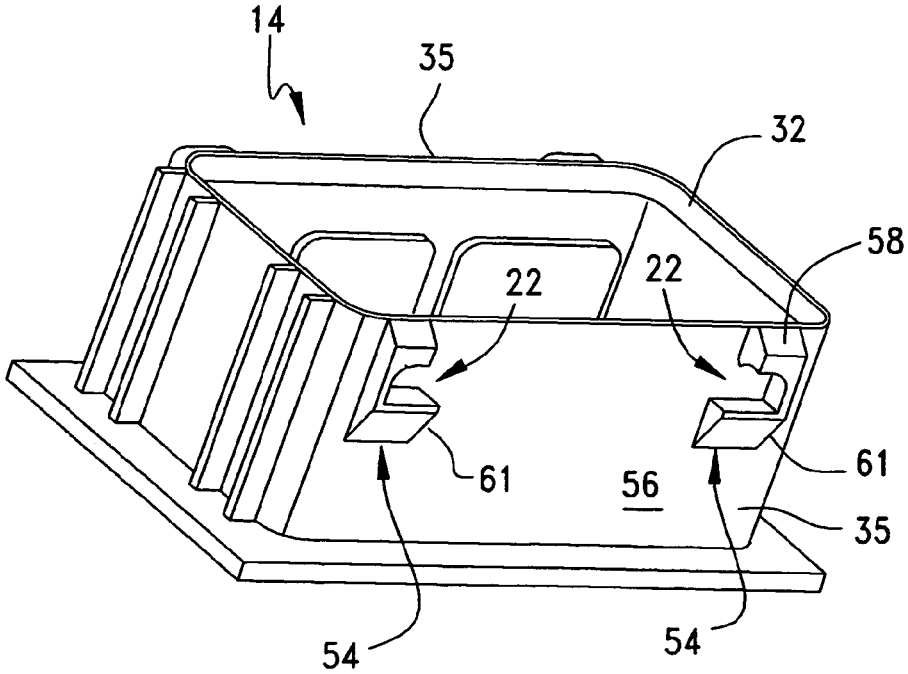
FIG. 2A is another perspective view of the second connector shown in FIG. 1.

Referring to the drawings in greater detail, and first to FIGS. 1, 2 and 2A, a lever-type electrical connector assembly 10 is illustrated that includes a first connector or housing 12 and a second connector or header 14. Each connector 12 and 14 includes a plurality of electrical contacts (not shown) received therein. Typically, the assembly 10 includes greater that 90 electrical contacts and, when assembled, is at least about 70 mm wide, about 60 mm long, and about 60 mm high. In one preferred example, the connector 10 may include 98 electrical contacts and be configured as a harness connector for diesel engines; however, other uses, sizes, and configurations of the connector 10 are also possible.

Connectors of such size and configuration typically require greater than about 300 N of force to overcome frictional and engagement forces in order to mate or un-mate the header 14 and the housing 12. To this end, the connector 10 further includes a lever actuator 16 having a first, pre-mate, or release position shown at least in FIG. 4 (side view) and FIG. 5 (top view) and a second, mated, or lock position shown at least in FIG. 6 (side view) and FIG. 7 (top view). The lever actuator 16 is arranged and configured to linearly urge or advance the second connector 14 into a mating relationship with the first connector 12 upon the lever actuator 16 being shifted or pivoted from the pre-mated position of FIG. 4 to the mated position of FIG. 6. As further described below, the connectors 12 and 14 and the lever 16 are configured for efficiently mating the larger size connectors as described above. The lever 16 is generally more robust than prior levers to maximize the mechanical advantage thereof with little or no wasted input force to overcome play in the pivoting of the lever.

More specifically, to effect such mating, the lever actuator 16 includes a cam projection 18 on an actuating end 20 thereof while another cam projection 19 is rotatably mounted on housing 12. Each cam projections 18, 19 is configured to engage a respective one of a pair of facing cam grooves 22 positioned on each longitudinal side wall 35 of the header 14 so that shifting of the lever actuator 16 from the first to the second position causes the connectors 12 and 14 to linearly advance to be fully mated with each other. When fully mated, the lever 16 includes a latch member 24 thereon that cooperates with a locking member 26 positioned on the housing 12 to lock the lever 16 in the mated position. The locking member 26 blocks reverse movement of the lever 16. To release the lever 16 from the mated position, a resilient release tab 28 on the locking member 26 is depressed and biased inward toward housing 12 to permit free movement of the lever 16.

The connector assembly 10 generally includes male and female connector portions. For example, the first connector 12 is formed from a wall 30 that defines a generally rectangular housing for the electrical contacts (not shown) of a female connector. The second connector 14 is formed from a corresponding wall 32 that also defines a generally rectangular header for corresponding electrical contacts (not shown) to form a male connector that is receivable in the female connector. Manifestly, the first connector 12 can be a male connector and the second connector 14 can be a female connector. As shown, the lever 16 is mounted to the first connector 12 and arranged to shift or pivot from the pre-mated to the mated position in the direction of arrow "A".

Figure 3:
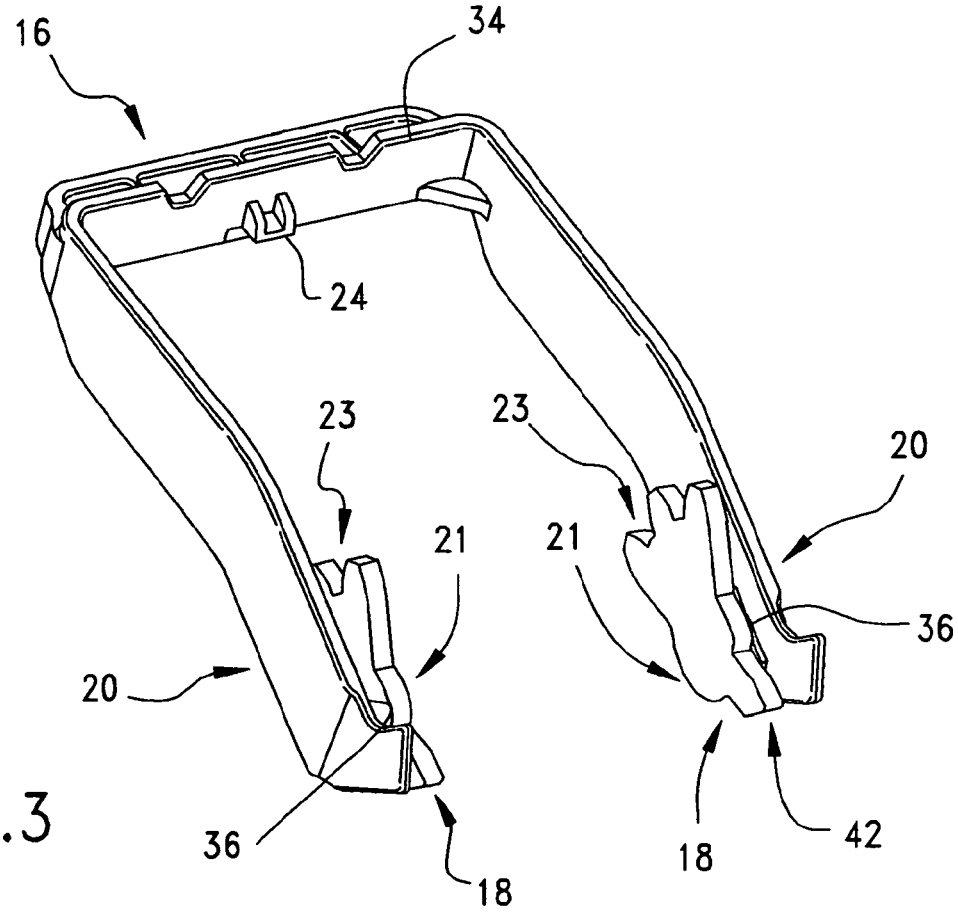
FIG. 3 is a perspective view of an embodiment of the actuating lever showing a force input end and lever arm drive gear having gear teeth and a cam projection including at least one predetermined force transmitting engagement portion thereof.

Referring to FIGS. 1-3, the lever actuator 16 is a generally "U-shaped" structure having a pair of end portions 20 and a center connecting portion 34 that connects the two end portions. The center connector portion 34 further includes the previously described latch member 24. Each end portion 20 includes a pivot element 36. Connected to pivot element 36 is lever arm drive gear 21 that includes cam projection 18 at one end and a set of gear teeth 23. Cam projection 18 can be spaced approximately 135° from gear teeth 23. Pivotally mounted on the inner surface 31 of each of opposing longitudinal side walls 33 is complementary follower/mating gear or housing drive gear 25 positioned to engage lever arm drive gears 21. Movement of lever arm 16 causes lever arm drive gears 21 to pivot. The pivoting motion of drive gears 21 is transferred through gear teeth 23 to gear teeth 27 causing housing drive gears 25 to pivot in tandem with drive gears 21. As drive gears 21, 25 pivot in tandem so do cam projections 18, 19. Cam projections 18, 19 engage their respective cam grooves 22 to draw housing 12 and header 14 together. This pivoting action is shown also in FIGS. 15 and 16.

The lever 16 is pivotally mounted to the first connector 12 by the pivot elements 36 being received in key-hole slots 38, and in particular, a pivot opening (not shown) is formed in a portion of longitudinal side wall 33. The pivot element 36 and pivot opening allow for pivotal movement of the lever 16. As further discussed below, the cam projections 18, 19 include one or more discrete predetermined force transmitting engagement portions 42 that are configured to transmit a leveraged force upon pivoting of the lever 16 to either mate or un-mate the first connector 12 and the second connector 14.

Figure 18:
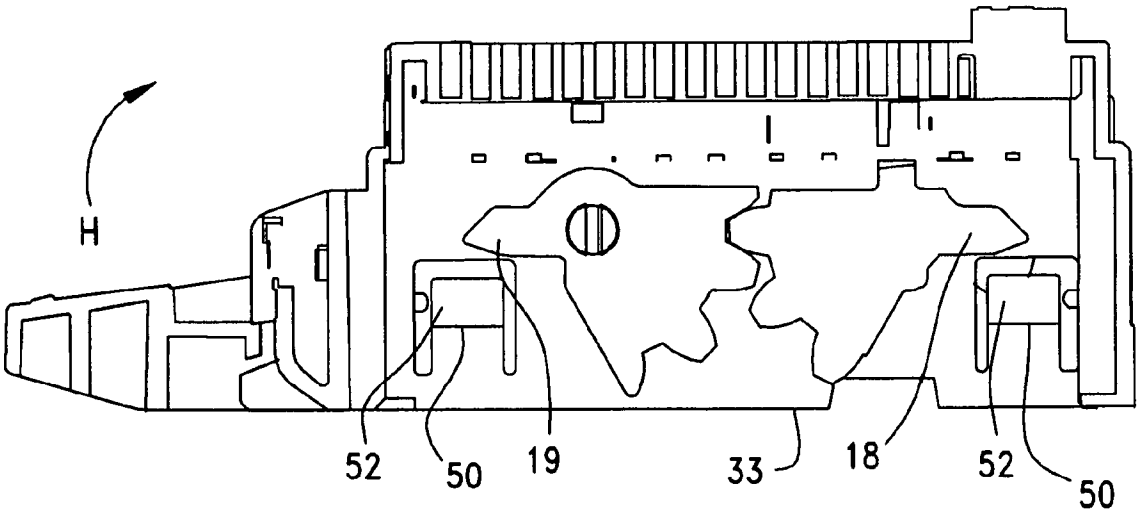
FIG. 18 is a cross-sectional view of first or housing connector showing lever arm drive gear engaged with housing drive gear in the mated or locked position.

The connector assembly 10 includes an engagement system for retaining the actuating lever 16 in the pre-mate position to minimize any re-alignment prior to mating the connectors. To this end, the engagement system blocks shifting of the lever 16 in the mating direction "A" via a blocking portion 50 of the first connector housing wall 30, particularly longitudinal side wall 33. Preferably, the blocking portion 50 is in the form of a resilient lever stop projection or tab that extends inwardly to a cavity formed by the longitudinal side wall 33 as best illustrated in FIGS. 17 and 18. In one form, the blocking portion 50 includes a thin wall extension or a resilient tab 52 that extends inwardly to the cavity formed by the connector wall 30. The blocking portion 50 is configured to prevent shifting of the lever 16 in direction "A" (FIGS. 1, 2, and 17) when in the pre-mate position. As perhaps best shown in FIGS. 17 and 18, such blocking is accomplished when the blocking portion 50 is in its first, unbiased position because cam projections 18, 19 abut side surfaces 53 of tab portion 52. This arrangement blocks or interferes with movement of the cam projections 18, 19 and substantially prohibits any pivoting of the actuating lever 16 in a mating direction "A".

Figure 4:
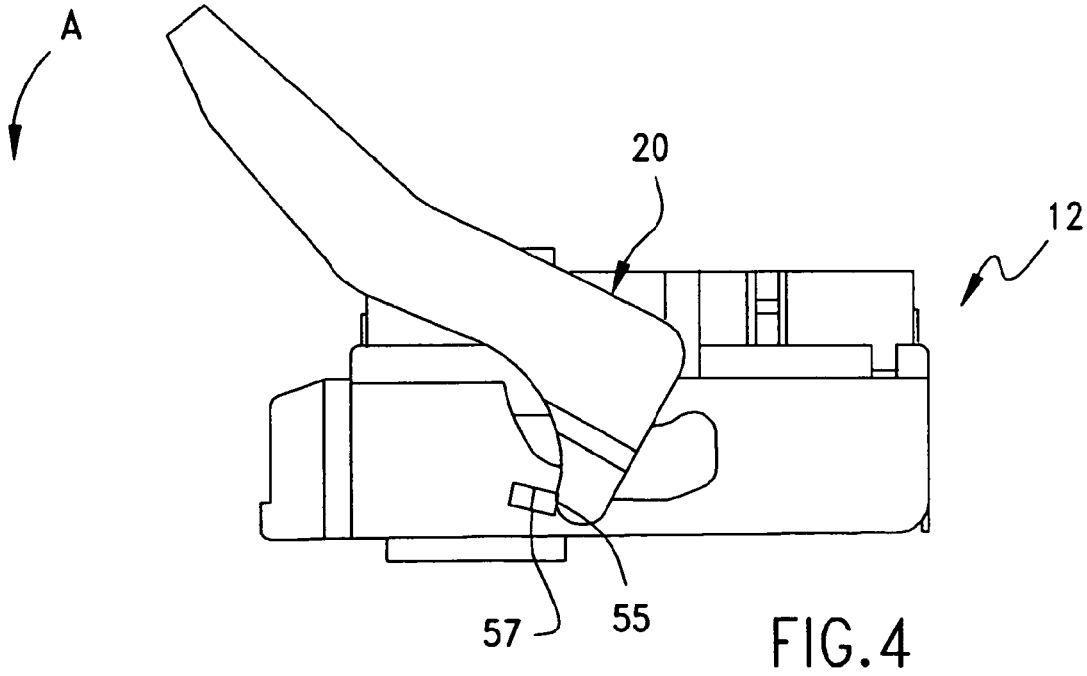
FIG. 4 is a side elevation view of the first or housing connector showing a blocking protrusion for blocking the shifting of the actuating lever from the pre-mate or first position in a direction opposite the mating direction.
Figure 5:
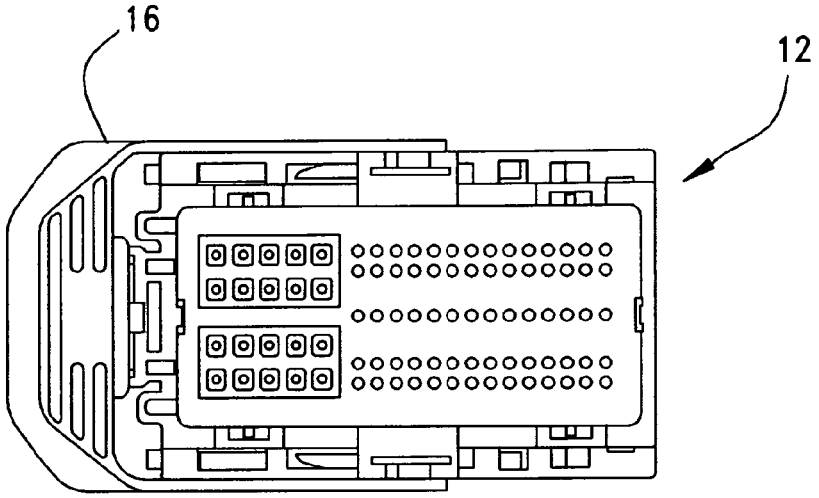
FIG. 5 is a plan view of the first or housing connector showing the actuating lever in the first or pre-mate position.

As also shown in FIGS. 1, 2 and 4, when the lever 16 is in the first or pre-mate position, it is also blocked from reverse shifting through engagement of surface 55 of the lever end 20 against a projecting tab 57 on the outer surface of each longitudinal side wall 33. As a result, in the pre-mate position, the lever is restrained from both forward and reverse movement because it is captured between the blocking portion 50 and the projecting tab 57.

Referring again to FIGS. 1 and 2A, the housing wall 32 of the second connector 14 preferably includes a release portion 54 that extends outwardly from each longitudinal side wall portion 56 of the second connector wall 32. The release portion 54 is positioned so that upon the second connector 14 being inserted into the first connector 12, the release portion 54 shifts the blocking portion 50 from its blocking or first position to a clearance or second position to permit movement of the lever 16. To this end, the release portion 54 includes a lead-in cam surface 58 at the front of the release portion 54 that is configured to cammingly engage the blocking portion 50 and shift it to the clearance position upon the second connector 14 being initially inserted into the first connector 12.

More specifically, to release the actuating lever 16 and allow pivotal movement thereof in direction "A" to fully mate the connectors 12 and 14, the second connector 14 is brought into initial engagement with the first connector 12 to release the blocking portion 50. Upon the initial insertion of the connectors 12 and 14, the release portion 54 on the second connector 14 enters the first connector 12 and the lead-in cam surface 58 of the release projection 54 shifts or deflects the resilient lever stop projection 50 out of engagement with the flat portion 42 of the cam projection 18 and, therefore, allows the lever 16 to be pivoted in the mating direction "A". To this end, the lead-in cam surface 58 is inclined so that it cammingly engages a corresponding cam surface 60 on the blocking portion 50 to resiliently shift the blocking portion outwardly. Once the blocking portion 50 is shifted to the clearance or second position, the lever 16 is free to shift or pivot in the mating direction "A" to linearly advance the second connector 14 into a mating relationship with the first connector 12.

Once fully mated, the releasing projection 54 further includes a second cam surface 61 that is sized to allow blocking portion 50 to shift back to its original position. The receiving second cam surface 61 permits the blocking portion 50 to generally be unstressed or unbiased when the connectors 12 and 14 are fully connected.

In order to linearly advance or urge the connectors 12 and 14 together into a mating relationship, the lever actuator 16 is pivoted by a user to cause lever arm drive gears 21 to rotate or pivot and urge cam projections 18 to pivot accordingly. As gear teeth 23 of each lever arm drive gear 21 are positioned in engaging relation with associated gear teeth 27 of housing drive gear 25, rotation or pivoting of lever arm drive gear 21 results in rotation or pivoting of housing drive gear 25 and its corresponding cam projection 19. Cam projections 18, 19 engage their respective cam grooves 22 in the second connector 12 to linearly advance or urge the second connector 14 into the first connector 12 using a predetermined leveraged mechanical advantage provided by the lever 16. In particular, such linearly advancement is achieved via the mechanical advantage obtained from the one or more predetermined force transmitting engagement portions 42 provided on each of the cam projections 18, 19. As shown, the cam groove 22 is a straight groove or pocket, but it may alternatively take a curvilinear, angled, or stepped shape as well as other forms depending on the force requirements needed to engage and disengage the connectors.

Referring to FIGS. 9 and 10, one preferred embodiment of cam projection 18 is illustrated in more detail. In the illustrated embodiments, cam projections 18, 19 have identical force transmitting portions 42 and are positioned in mirror opposite relation to mate with the pair of facing cam grooves 22 (also in mirror opposite relation) on each side of longitudinal side walls 35. Accordingly, the description of cam projection 18 which follows applies equally to all the cam projections 18, 19. Additionally any description of the interaction of cam projection 18 with cam groove 22 also applies to interaction of projection 19 with its respective cam groove 22. As described above, the cam projections 18, 19 include one or more predetermined force transmitting engagement portions 42. More specifically, the cam projection 18 preferably includes at least one mating predetermined force transmitting engagement portion 62 on one side of the cam projection 18 and at least two un-mating predetermined force transmitting engagement portions 68 and 70 on other sides of the cam projection 18. Depending on the force requirements, however, more or less engagement portions may also be provided. Each predetermined force transmitting engagement portion is configured to provide a discrete, leveraged mating or un-mating force upon engagement with a surface of the cam groove 22 during pivoting of the lever actuator 16. By one approach, each engagement portion 62, 68, and/or 70 is in the form of a protrusion, corner, knuckle, or other extension of the cam projection 18 that is positioned to engage the walls of the cam groove 22 generally without other surfaces of the cam projection 18 contacting the cam groove 22.

Turning to the mating sequence, the cam protrusion 18 includes the mating predetermined force transmitting engagement portion 62 positioned on the outer surface of the cam protrusion 18 a predetermined distance "C" from the pivot element 36 so that a predetermined leverage ratio "LR1" is formed in relation to a predetermined distance "D" from the pivot element 36 to a user or force-input end 64 of the lever 16. In this manner, the leverage ratio "LR1" (i.e., D:C) is provided that permits the lever actuator 16 to provide a mating force of at least about 300 N derived from a user input force of less than about 75 N. In one example, it is preferred that the leverage ratio "LR1" is at least about 7:1 where the distance "D" is about 7× the distance "C". In a preferred example, the distance "C" is about 6.6 mm and the distance "D" is about 48.2 mm to provide a leverage ratio "LR1" of about 7.3:1.

Regarding the un-mating sequence, the cam projection 18 includes at least one un-mating predetermined force transmitting engagement portion 42 and, preferably, the cam projection 18 includes a pair of un-mating predetermined force transmitting engagement portions 42 (i.e., the protrusions 68 and 70). As a result, the lever 16 is configured to provide a sequential, dual stage leveraged output force upon applying substantially the same user input force to the force-input end 64 of the lever 16 during un-mating of the connector 10 (i.e., direction arrow "H" in FIG. 18). Turning again to FIGS. 13 and 14, the cam projection 18 includes a first un-mating force transmitting engagement portion 68 dimensioned relative to the force-input end 64 and pivot element 36 to provide an initial un-mating stage that generates a high level of output force. The cam projection 18 also includes a second un-mating force transmitting engagement portion 70 dimensioned a different distance relative to the force-input end 64 and pivot element 36 to provide a subsequent or second un-mating stage generating a lower lever of output force. In both stages of un-mating, the high and low level of output force is achieved upon a user applying substantially the same amount of input force to the force-input end 64 of the lever actuator 16.

More specifically, the first un-mating predetermined force transmitting engagement portion 68 is positioned a predetermined distance "E" from the pivot element 36 so that a predetermined leverage ratio "LR2" is formed in relation to a predetermined distance "F" from the pivot element 36 to the user or force-input end 64 of the lever 16. In order to form the leverage ratio "LR2" (i.e., F:E) that permits the lever actuator 16 to provide the first-stage or a high level of un-mating force (i.e., generally an un-mating force greater than about 300 N) derived from a user input force of less than about 75 N, it is preferred that the leverage ratio "LR2" is at least about 8:1 where the distance "F" is at least about 8× the distance "E". In one preferred embodiment, the distance "E" is about 5.7 mm and the distance "F" is about 50.5 mm to provide a leverage ration "LR2" of about 8.8:1. This initial high level of un-mating force is beneficial in order to overcome the high frictional forces holding the connector housing together and the combined frictional forces holding the 90 or greater electrical connectors together.

During the continued un-mating sequence, once the initial frictional forces are overcome during un-mating, it is generally not necessary to continue to provide such high level of un-mating force. To this end, the lever cam projection 18 provides the second un-mating predetermined force transmitting engagement portion 70 positioned a different distance from the pivot element 36 than the first engagement portion 68. As a result, once the initial high level of frictional forces have been overcome, the cam projection 18 switches from the first stage (high level) to the second stage (low level) of un-mating where the same or less input force continues to un-mate the connectors with a lower level of un-mating force.

More specifically, the second un-mating predetermined force transmitting engagement portion 70 is positioned a longer, predetermined distance "G" from the pivot element 36 so that a second, un-mating predetermined leverage ratio "LR3" is formed in relation to the predetermined lever un-mating arm distance "F" to provide the lower level of output force. In order to faun the leverage ratio "LR3" (i.e., F:G) that permits the lever actuator 16 to providing a subsequent, lower level of un-mating force for the second or subsequent stage of un-mating (i.e., an un-mating force less than about 300 N) derived from the same user input force of less than about 75 N, it is preferred that the second stage of an un-mating leverage ratio "LR3" is at least about 5:1 where the distance "F" is at least about 5× the distance "G". In one preferred embodiment, the distance "G" is about 8.9 mm and the distance "F" is about 50.5 mm to provide a leverage ratio "LR3" of about 5.6:1. As a result, with a larger distance "G" relative to the distance "F", less mechanical advantage is obtained in the second stage of un-mating so that the same input force generates less output force to un-mate the connectors.

As mentioned above, such dual stage un-mating is advantageous because it permits an initial, high level of un-mate force to overcome the higher frictional and engagement forces holding the first and second connectors 12 and 14 together (including the forces holding the 90 or greater pin contacts together), but allows a subsequent, lower level of un-mating force to be applied upon further disengagement of the connectors 12 and 14 when such higher force levels are generally not needed because the frictional and engagement forces are lower. In the case of a connector having 90 or more pin contacts, the initial frictional forces holding this large number of connectors is much larger than the prior connectors that having less than half the number of contacts. Thus, the lever designs of the prior connectors generally can not efficiently mate and un-mate the large connector with input forces less than 75 N as generally required by automotive industry standards.

Figure 11:
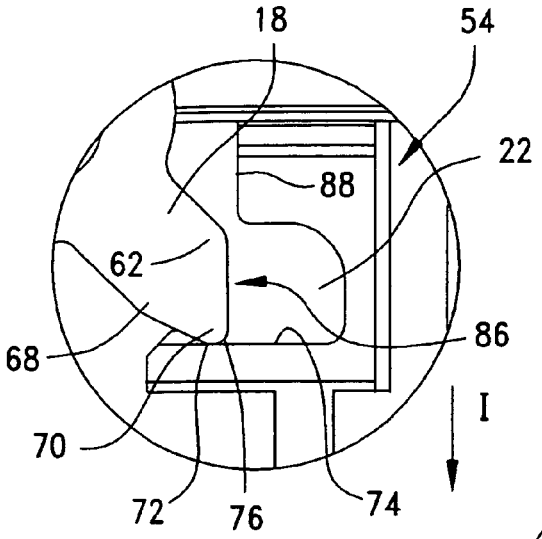
FIG. 11 is a detail elevational view of the lever cam projection in a pre-mate position relative to the cam groove showing an abutment surface and a drive surface of the second connector cam groove or pocket.

Turning to FIGS. 11 to 14, an exemplary mating sequence of the cam projection 18 and cam groove 22 is illustrated. FIG. 11 shows the cam projection 18 and cam groove 22 in the pre-mate position where a distal end 72 of the cam projection 18 engages an abutment edge or surface 74 of the cam groove 22. The abutment edge 74 of the cam groove 22 is a surface defining one boundary of the cam groove or pocket 22 that extends generally orthogonal to the linear insertion direction "I" (FIG. 11) of the connectors 12 and 14. The abutment edge 74 generally includes a stop portion 76 that is positioned to provide a hard stop to the insertion of the cam projection 18 as best shown by the engagement of cam projection distal end 72 against the abutment edge 74 in FIG. 11. At this point of the mating cycle, the user is signaled that the pre-mate position has been achieved and that further mating can be accomplished via shifting or pivoting of the lever actuator 16 because the cam projection 18 is positioned for engagement with the cam groove 22.

Figure 12:
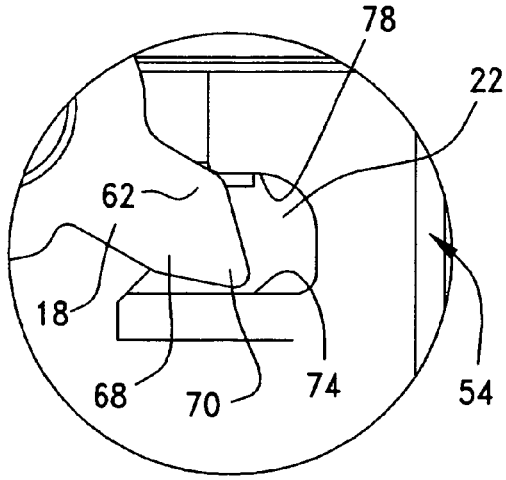
FIG. 12 is a detail elevational view of the lever cam projection shown approximately 15° into a mating sequence with a protrusion on the cam projection engaging the drive surface of the cam groove to linearly advance the second connector into a mating relationship with the first connector.
Figure 13:
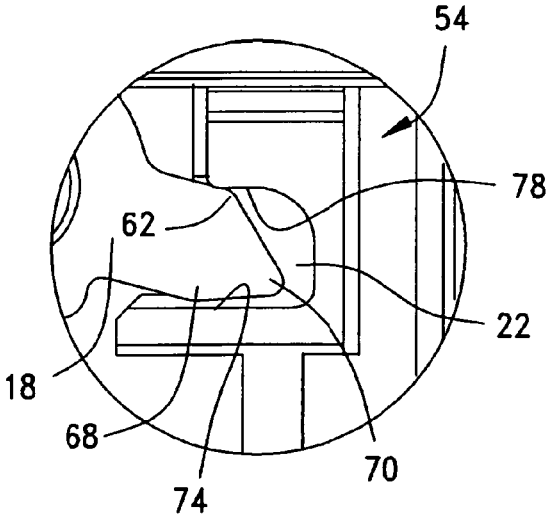
FIG. 13 is a detail elevational view of the lever cam projection shown approximately 30° into a mating sequence with the protrusion of the cam projection continuing to engage the drive surface of the cam groove.
Figure 14:
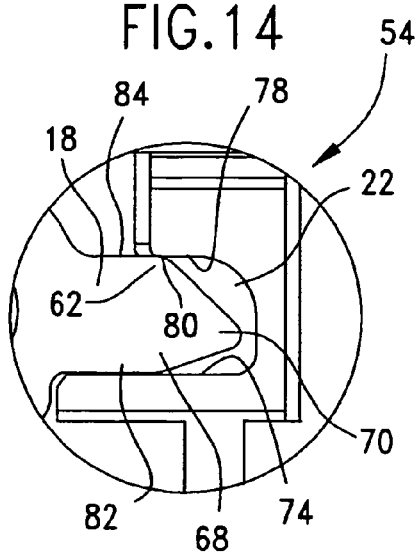
FIG. 14 is a detail elevational view of the lever cam projection shown in the mated position with opposing flats of the cam projection engage corresponding portions of the abutment and drive surfaces of the cam groove.

Next, FIG. 12 shows the lever actuator 16 shifted or pivoted about 15° into the mate sequence where the mating predetermined force transmitting engagement portion 62 engages a drive edge 78 of the cam groove 22. The drive edge 78 of the cam groove 22 is on the opposite side of the groove 22 from the abutment edge 74 and provides a drive surface for the mating predetermined force transmitting engagement portion 62 to apply a leveraged force thereto to advance the second connector 14 in a mating engagement with the first connector 12. Upon further shifting of the lever, FIG. 13 shows the lever actuator 16 shifted or pivoted about 30° into the mate sequence where the same mating predetermined force transmitting engagement portion 62 is still engaging the drive edge 78 for continued urging of the connectors 12 and 14 together. Upon continued shifting or pivoting of the actuating lever 16, the interaction of the cam groove 22 and the cam projection 18 draws the second connector 14 into full engagement with the first connector 12 where the lever actuator 16 is in the second or mated position. FIG. 14 shows the cam projection 18 and the cam groove 22 is this fully mated position where the second connector 14 is fully received with the first connector 12. In such position, opposing flats 80 and 82 on opposite sides of the cam projection 18 help secure the cam projection 18 in this mated position. That is, for example, flat 80 abuts against the drive surface 78 and flat 82 abuts against the abutment surface 74. As discussed previously, when the lever actuator 16 is in the second or mated position, the latch member 24 on the center connecting portion 34 of the lever actuator 16 engages a cooperative lock member 26 on the first housing 12 to secure the lever actuator 16 in the second position.

During the mating sequence, the cam projection 18 is preferably configured to have a single or discrete engagement portion that contacts the cam groove drive surface 78. Preferably, the single engagement portion contacts this drive surface throughout the mating sequence to provide a discrete and constant level of leveraged mating force. This single engagement portion is in contrast to prior connectors that include engagement surfaces or curved cam portions that provide a rolling or variable engagement between the cam and groove during the mating sequence, which also provide a variable amount of mating force depending on the position of the various cam surfaces. In this case, the single engagement portion during mating provides a constant and increased level of mating force suitable to mate the above described large connectors.

Figure 15:
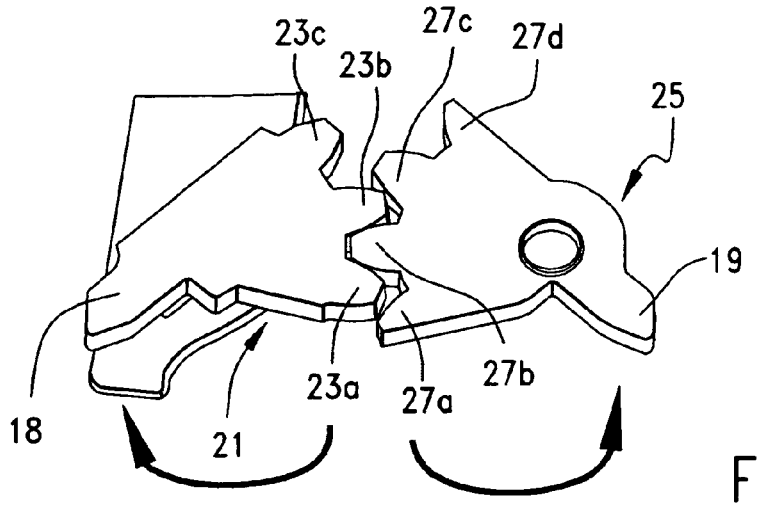
FIG. 15 is a detail perspective view of the lever arm drive gear engaged with housing drive gear with cam projections in the pre-mate or first position.
Figure 16:
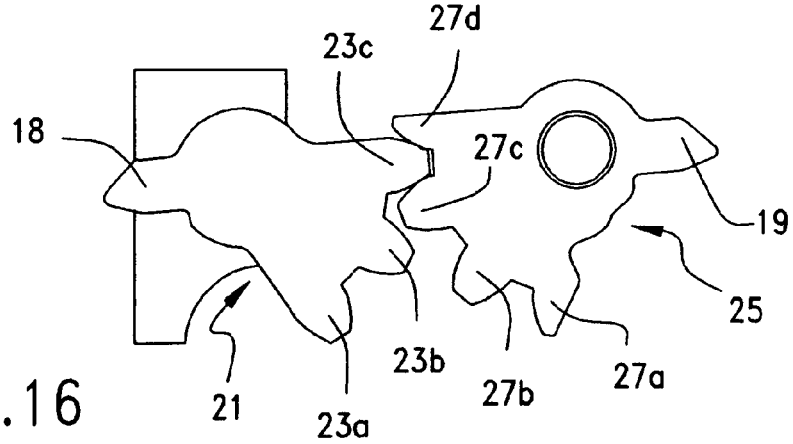
FIG. 16 is a detail elevational view of the lever arm drive gear engaged with housing drive gear with cam projections in the mated or locked position.

In the embodiments shown in FIGS. 15 and 16, each lever arm drive gear 21 can have three gear teeth 23*a*, 23*b*, 23*c*. Each housing drive gear 25 can have four gear teeth 27*a*, 27*b*, 27*c*, 27*d* defining three channels therebetween for receiving gear teeth 23*a*, 23*b*, 23*c*. Pivoting of drive gears 21, 25 from the unmated position shown in FIG. 15 to mated position shown in FIG. 16 can result in lever arm 16 pivoting by about 45° and can result in positioning cam projection 18, 19 in approximately a linear alignment facing away from each other.

Figure 6:
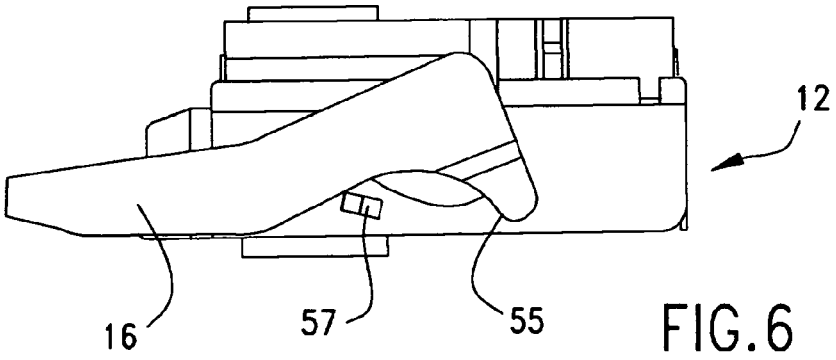
FIG. 6 is a side elevation view of the first or housing connector showing the lever in the second, mated or locked position.
Figure 7:
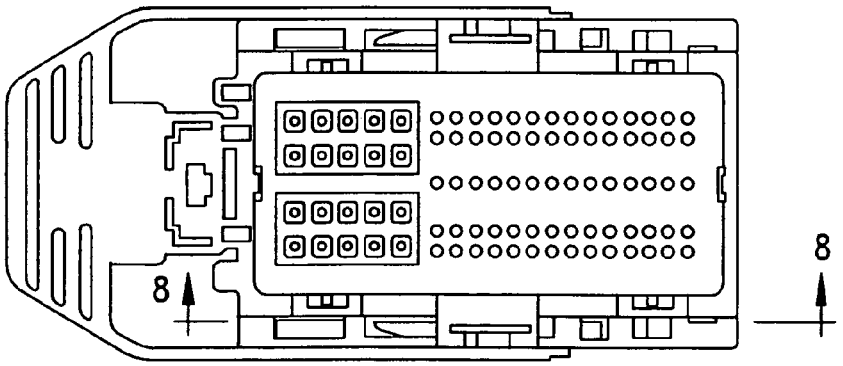
FIG. 7 is a plan view of the first or housing connector showing the lever in the second, mated or locked position.
Figure 19:
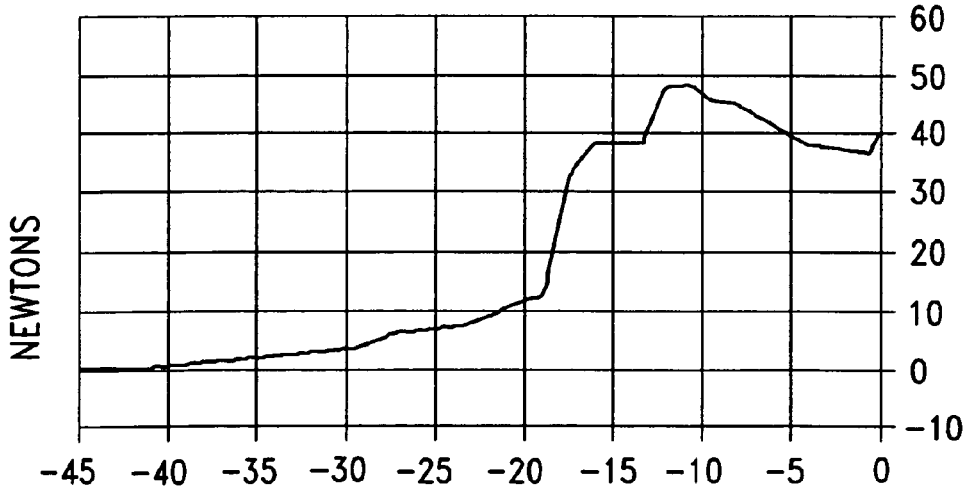
FIG. 19 is a graph of rotation position of lever versus force in Newtons to show user force input required at lever moves from un-mated to mated position.

FIG. 19 illustrates the force in N (Newtons) as lever is rotated or pivoted in degrees from the unmated position in the direction of arrow "A" shown in FIG. 1 approximately 45° to the mated position shown in FIGS. 6 and 18. From the initial 45° starting point shown in FIG. 1 to the 30° position relatively little force is required. From the 30° position to the 15° position, the force required increases substantially as the 15° position since the contacts or pins housed in one or both connector 12 and header 14 mated with complementary openings in the other of the connector 12 and header 14. The final 15° rotation requires less force as the final seating of pins or contacts occurs.

As shown in FIG. 14, the single predetermined engagement portion 62 contacts the drive surface 78 during the mating sequence because the cam projection 18 can have flat area 84 adjacent the engagement portion 62. The predetermined positioning of the flat area 84 adjacent the knuckle 62 is selected, so that during the mating sequence, generally only the portion 62 contacts the drive surface 78 to provide the desired mating force rather than other portions of the cam projection 18.

To facilitate the insertion of the cam projection 18 past the release projection 54, the cam projection 18 preferably includes a truncated corner or flat edge 86 (shown in FIG. 11) adjacent the distal end 72 and generally extending between the distal end 72 and the engagement portion 62. This flat surface 86 is positioned to permit the cam projection 18 to more easily slide across and clear an upper edge 88 of the release projection 54 with little or no frictional engagement upon the initial insertion of the second connector 14 into the first connector 12. In this manner, the cam projection 18 is configured to linearly advance along the upper surface 88 of the release projection 54 with little or no interference in order to reach the cam groove 22.

The un-mating sequence proceeds in reverse from FIG. 14 back through FIG. 11. The lever actuator 16 must first be unlatched from the lock member 26 by depressing the resilient tab 28 to provide clearance for the reverse shifting or pivoting of the lever actuator 16. Thereafter, the lever actuator 16 is free to move in an un-mating direction "H" (FIG. 18) by shifting or pivoting the lever actuator 16 in the un-mating direction. With such reverse motion of the lever actuator 16, the interaction between the cam groove 22 and the cam projection 18 urges or linearly separates the first connector 12 and the second connector 14 allowing the connectors to be unmated. As further described below, it is preferred to employ the dual stage un-mating sequence with an initial high level of un-mating force and a subsequent lower level of un-mating force to accomplish the un-mating of the connectors 12 and 14.

The dual-stage un-mating sequence is described in more detail starting with FIG. 14. To begin with, as the lever actuator 16 is shifted in the un-mating direction "H" about 15°, the cam projection 18 is shifted by an amount so that the first un-mating force transmitting engagement portion 68 contacts the abutment surface 74 to provide the first stage of un-mating force. As discussed above, this first un-mating engagement portion 68 is positioned to provide a high level of un-mating force to overcome the initial frictional and engagement forces between the connectors 12 and 14. In this configuration of the un-mating sequence, the second un-mating force transmitting engagement portion 70 is spaced from the first engagement portion and not contacting the groove walls as shown in FIG. 14.

Upon further pivoting of the actuation lever 16, the cam projection 18 reaches the general position illustrated in FIG. 12, which is about 30° into the un-mate sequence. In this position, the second un-mating force transmitting engagement portion 70 now contacts the abutment surface 74. As discussed above, this second un-mating engagement portion 68 is positioned to provide a lower level of un-mating force. In this position, the first engagement portion 68 is spaced from the second engagement portion 70 and not contacting the groove walls as best shown in FIG. 12. Upon further pivoting of the actuating lever 16 in the un-mating direction, the lever reaches the pre-mated position of FIG. 11, where the first and second connectors can then be manually separated. The connector 10 is now ready to be re-assembled following the mating procedures previously described.

Similar to the mating sequence, the un-mating sequence is configured to provide discrete leveraged forces. During un-mating, however, it is preferred that at least two discrete and constant un-mating forces supplied via the dual stage un-mating sequence be employed. This dual-stage leveraged force is also in contrast to the variable un-mating forces achieved from prior art camming surfaces that employ curved surfaces.

Figure 21:
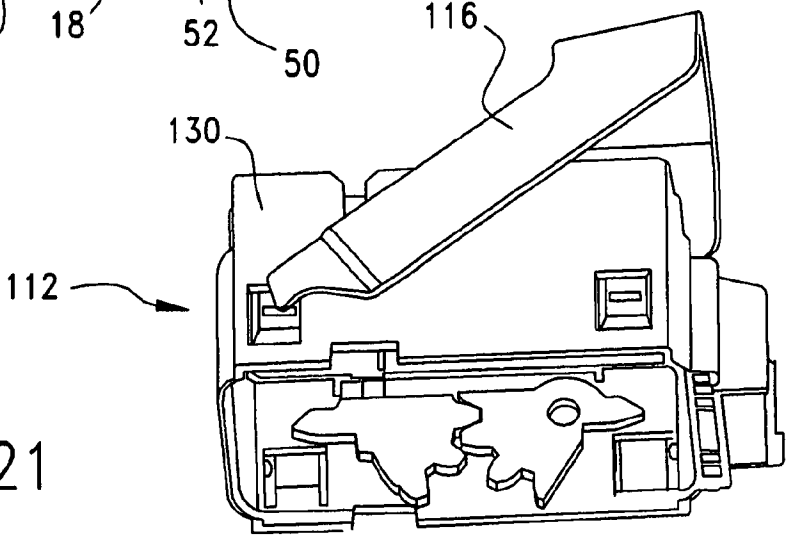
FIG. 21 is a perspective view of the first or housing connector shown in FIG. 20 with the lever arm in the mated or locked position.

Another embodiment of a lever connector is shown in FIGS. 20 and 21. Connector 112 has all the same features as connector 12 described above except for the position of lever 116. As shown in the unmated position in FIG. 20, lever 116 begins at approximately a 90° position relative to housing 130 as opposed to the approximately 45° initial unmated position of lever 16 of connector 12. Lever 116 can also rotate or pivot approximately 45° in the direction of arrow "B" to end in the mated position shown in FIG. 21 which is at about a 45° angle relative to housing 130.

It will be understood that the present embodiments provide mating assistance that draws the connectors together by four lever lobes or cam projections features. By such an approach, the connector halves are drawn together with their mating surfaces held parallel, with a reduced reliance on the connector shrouds to keep the mating surfaces parallel. This lever design having mate assist features in all four corners of the connector achieves locking and improved performance. This approach is more robust than standard post designs. The spur drive or gear tooth features help to equalize the force applied to the connectors to keep the connectors from wanting to shift and pinch the seals which adds the friction. The spur drive feature transfers force as if there were two mate assist levers-one at each end of the connectors. The drive frame arm gear transfers to mating gear providing mating and un-mating force as if a mate assist lever was directly connected to the mating gear.

As a result, the connector assembly 10 and actuator lever 16 are configured to provide a more robust assembly that is suitable to mate and un-mate large electrical connectors that include 90 or more pin contacts. It will be appreciated, however, that while the assembly 10 is particularly preferred for such large connectors, the connector assembly 10 and lever 16 are also suitable for connector configurations with more or less pin contacts. It will be further understood that the electrical connectors may be embodied in other specific forms without departing from the spirit or central characteristics thereof. The present examples and embodiments, therefore, are to be considered in all respects as illustrative and not restrictive, and the electrical connector is not to be limited to the details given herein. Indeed, the true measure of the scope of the present invention is defined by the appended claims including the full range of equivalents given to each element of each claim.

The invention claimed is:

1. A connector assembly comprising:

a first connector including a generally rectangular housing for carrying first electrical contacts, said housing having an access channel for receiving a lever assembly;

said lever assembly having a generally U-shape with opposite extending end portions;

a drive gear carried on the inner portion of each end portion, said drive gear having a lever lobe extending from one side and a plurality of drive teeth extending from another side;

a pair of mating gears rotatably carried by said first connector, each mating gear having a lever lobe extending from one side and a plurality of mating teeth extending from another side, said mating gears having their mating teeth in mating relationship respectively with said drive teeth of said drive gears;

a second connector defining a generally rectangular header for carrying second electrical contacts for respective connection to said first electrical contacts in response to said second connector being fully engaged with said first connector;

said header including a pair of cam tracks on each longitudinal side of the header for respectively receiving the lever lobes of the drive gears and mating gears;

said lever assembly having a first position whereat said header is in an unengaged position with respect to said first connector;

said lever assembly is rotatable to a second position whereat said drive gears and associated mating gears are moved to cause said lever lobes within said cam tracks to move said header to said fully engaged position;

said first connector includes a first blocking member for preventing the lever assembly from moving from the first position to the second position prior to engagement of the first and second connectors and a second blocking member for preventing said lever assembly from moving in a direction opposite the direction from the first position to the second; and said first blocking member is positioned on an inner surface adjacent one of said lever lobes and said second connector includes a release member positioned adjacent said cam track associated with said one of said lever lobes for releasing said blocking member to permit movement of said lever assembly to the second position.

2. The connector assembly of claim 1 wherein each of said lever lobes is positioned adjacent a corner of said first connector housing and each of said cam tracks is positioned adjacent a corner of said header.

3. The connector assembly of claim 1 wherein each of said lever lobes includes a first force transmitting portion for contacting its respective cam track and for moving said header to the fully engaged position.

4. The connector assembly of claim 3 wherein each of said lever lobes includes second and third force transmitting portions for contacting its respective cam track and wherein said second force transmitting portion applies a first force for moving said header from the fully engaged position towards said first position and said third force transmitting portion applies a second force for moving said header to the first unengaged position.

5. The connector assembly of claim 4 wherein said first force is greater than said second force.

6. The connector assembly of claim 1 wherein said lever includes a latching member and said first connector housing includes a lock member, said latch member engages said lock member when said lever is moved to said second position to lock lever in second position.

7. A connector assembly comprising:

a first connector including a housing for mounting first terminals; said first connector housing having a first side and a second side opposite said first side, each of said first and second sides of said first connector housing including a follower gear pivotally mounted thereto and having gear teeth at one end and a cam projection at another end;

a second connecter including a housing for mounting second electrical terminals for respective connection to said first terminals upon mating of first and second connectors; said second connector housing including a first side and a second side opposite said first side and a pair of spaced apart cam grooves on each of said first and second sides of said second connector housing; and a lever movable from a first position to a second position and including two arms, each arm mounted to opposite sides of said first connector housing and including an end portion, each end portion including a drive gear having gear teeth at one end and a cam projection at another end; said gear teeth of each of said drive gears positioned in engaging mating relation with said gear teeth of a corresponding follower gear such that drive gears and follower gears can be pivoted by movement of said lever;

with said lever is in said first position, each cam projection is in a position to be received in a respective cam groove and movement of said lever from said first position to said second position causes cam projections received in said cam grooves to bring first and second connectors together to a fully mated position;

wherein said first connector includes a first releasable blocking member for preventing the lever from moving from the first position to the second position prior to first connector contacting second connector and a second blocking member for preventing said lever from moving in a direction opposite the direction from the first position to the second while in the first position; and wherein said first blocking member is positioned on an inner surface adjacent one of said cam projections and contacting relation therewith and said second connector includes a release member positioned adjacent said cam groove associated with said one of said cam projections for releasing said blocking member to permit movement of said lever to the second position.

8. The connector assembly of claim 7 wherein each of said cam projections is positioned adjacent a corner of said first connector housing and each of said cam grooves is positioned adjacent a corner of said second connector housing.

9. The connector assembly of claim 7 wherein each of said cam projections includes a first force transmitting portion for contacting its respective cam groove and for moving said first and second connectors to the fully mated position.

10. The connector assembly of claim 9 wherein each of said cam projections includes second and third force transmitting portions for contacting its respective cam groove and wherein said second force transmitting portion applies a first force for moving said header from the fully mated position towards a partially unmated position and said third force transmitting portion applies a second force for moving said header to a fully unmated position wherein said lever is in said first position.

11. The connector assembly of claim 10 wherein said first force is greater than said second force.

12. The connector assembly of claim 7 wherein said lever includes a latching member and said first connector housing includes a lock member, said latch member engages said lock member when said lever is moved to said second position to lock lever in second position.

13. A connector assembly comprising:

a first connector having a generally rectangular housing for carrying first electrical contacts, said housing having a latch member;

a U-shaped lever assembly having first and second opposing arms connected by a bridge member, said first and second arms pivotally mounted to said first connector housing, each arm having an end portion, said lever assembly having a locking member for engaging said latch member to prevent movement of said lever assembly;

a drive gear carried on the inner portion of each end portion, said drive gear having a cam projection extending from one side and a plurality of drive teeth extending from another side;

a first mating gear pivotally mounted to a first longitudinal side of said first connector housing adjacent a corner thereof and a second mating gear pivotally mounted to an second opposite longitudinal side of said first connector housing adjacent a corner thereof, each mating gear having a cam projection extending from one side and a plurality of mating teeth extending from another side, said mating gears having their mating teeth in mating relationship respectively with said drive teeth of said drive gears;

a second connector defining a generally rectangular header for carrying second electrical contacts for respective connection to said first electrical contacts in response to said second connector being fully engaged with said first connector;

said header including a pair of cam tracks on each longitudinal side of the header for respectively receiving the cam projections of the drive gears and mating gears; and said cam tracks are positioned adjacent a corner of the housing, said lever assembly movable from a first position where said cam projections are positioned to engage cam tracks to a second position wherein said drive gears and associated mating gears are moved to cause said cam projections to engage said cam tracks to move said first and second connector to a fully mated position;

wherein said first connector includes a first blocking member for preventing the lever assembly from moving from the first position to the second position prior to contact between the first and second connectors and a second blocking member for preventing said lever assembly from moving in a direction opposite the direction from the first position to the second while in the first position; and wherein said first blocking member is positioned on an inner surface adjacent one of said cam projections and said second connector includes a release member position adjacent said cam groove associated with said one of said cam projections for releasing said blocking member to permit movement of said lever assembly to the second position.

14. The connector assembly of claim 13 wherein each of said cam projections includes a first force transmitting portion for contacting its respective cam track and for moving said first and second connectors to the fully mated position.

15. The connector assembly of claim 14 wherein each of said cam projections includes second and third force transmitting portions for contacting its respective cam track and wherein said second force transmitting portion applies a first force for moving said header from the fully mated position towards a partially unmated position and said third force transmitting portion applies a second force for moving said header to a fully unmated position wherein said lever assembly is in the first position.

16. The connector assembly of claim 15 wherein said first force is greater than said second force.

* * * * *